United States Patent [19]

Yano et al.

[11] 4,300,421

[45] Nov. 17, 1981

[54] TRIM GUIDE DEVICE FOR SLITTER-SCORERS

[75] Inventors: Tadashi Yano; Yoshiaki Maruyama, both of Mihara; Masahiro Toyota, Hiroshima, all of Japan

[73] Assignee: Mitsubishi Jukogyo Kabushiki Kaisha, Tokyo, Japan

[21] Appl. No.: 131,674

[22] Filed: Mar. 19, 1980

[30] Foreign Application Priority Data

Mar. 23, 1979 [JP] Japan ..... 54-37773[U]

[51] Int. Cl.[3] ..... B26D 7/18

[52] U.S. Cl. ..... 83/99; 83/100; 83/402

[58] Field of Search ..... 83/22, 24, 53, 98, 99, 83/100, 113, 165, 177, 402, 438, 923

[56] References Cited

U.S. PATENT DOCUMENTS

| | | | |
|---|---|---|---|
| 3,076,366 | 2/1963 | Granstedt | 83/98 |
| 3,143,016 | 8/1964 | Obenshain | 83/402 X |
| 3,198,046 | 8/1965 | De Angelo | 83/98 X |
| 3,227,017 | 1/1966 | Bader | 83/24 |
| 3,438,295 | 4/1969 | Heinz et al. | 83/98 |
| 3,680,441 | 8/1972 | Parker | 83/99 X |
| 4,242,934 | 1/1981 | Coburn | 83/100 |

FOREIGN PATENT DOCUMENTS

| | | | |
|---|---|---|---|
| 1118158 | 4/1958 | Fed. Rep. of Germany | 83/98 |

*Primary Examiner*—Frank T. Yost
*Assistant Examiner*—Robert P. Olszewski
*Attorney, Agent, or Firm*—Bernard, Rothwell & Brown

[57] ABSTRACT

A trim guide device for slitter-scorers in which a corrugated board sheet transferred on guide tables is slit by rotary elements disposed above and below the corrugated board sheet, to be thereafter scored by similar rotary elements, comprising air ejection means disposed under the lower surface of those portion of said guide tables which are on the upstream side with respect to the flow of the corrugated board sheet of said rotary elements, and adapted to eject air toward the downstream side of the flow of the corrugated board sheet. The trims at both ends of the corrugated board sheet which has been subjected to slitting by means of said rotary elements are correctly guided by currents of air ejected from the air ejection means into the trim chute disposed on the downstream side of the guide table.

4 Claims, 4 Drawing Figures

TRIM GUIDE DEVICE FOR SLITTER-SCORERS

BACKGROUND AND DISCUSSION OF THE INVENTION

The present invention relates to a trim guide device for slitter-scorers for slitting and scoring the corrugated board sheets, and more particularly to such a trim guide device wherein the trims at both ends of the corrugated board sheets after slitting are correctly guided by currents of air into the trim chute.

A conventional slitter-scorer will be described with reference to FIGS. 1 and 2.

A corrugated board sheet 1 continuously transferred on guide tables 7 from a preceding step in the direction of an arrow is slit in the direction in which the corrugated board sheet 1 is transferred, by several slitter knives 3 mounted on rotary shafts 2 disposed above and below the corrugated board sheet 1, and thereafter scored by several scoring rolls 5 mounted on rotary shafts 4, the corrugated board sheet being then transferred to a subsequent step.

FIG. 2 shows the condition of a corrugated board sheet 1 which has been slit and scored as mentioned above. The corrugated board sheet 1 is slit as shown in full lines in a position designated by an arrow X in the direction in which the corrugated board is transferred, and thereafter scored as shown in broken lines in a position designated by an arrow Y. At this time, trims (ears) 6 at both ends of the corrugated board sheet 1, which have been separated by the slitter knives 3, are guided by the guide tables 7, sucked by trim chute (ear sucking means) 8, and then transferred to an ear treating means 9.

Since the trims 6 are guided by the guide tables 7 alone, they often drop, before they have been sucked into the trim chute 8, between the rotary shafts 2 and guide tables 7 or between the rotary shafts 4 and trim chute 8, or are wound around the rotary shafts 2, 4. Such trims 6 that fail to be sucked into the trim chute 8 must be removed. If the operation of the slitter-scorer is stopped in order to remove such trims, the work efficiency is decreased. Removing such trims during an operation of the slitter-scorer will put the workers in great jeopardy.

An object of the present invention is to provide a trim guide device which is free from the above described disadvantage, and which permits guiding trims at both ends of a corrugated board sheet correctly into a trim chute.

The present invention is directed to a trim guide device for slitter-scorers in which a corrugated board sheet transferred on guide tables is slit by rotary elements disposed above and below the corrugated board sheet, to be thereafter scored by similar rotary elements, comprising air ejection means disposed under the lower surface of those portions of the guide tables which are on the upstream side with respect to the flow of the corrugated board sheet of the rotary elements, and adapted to eject air toward the downstream side of the flow of the corrugated board sheet.

In a trim guide device of the above-described construction, trims at both ends of a corrugated board sheet which has been subjected to slitting are correctly guided by currents of air ejected from the air ejection means, into the guide tables disposed on the downstream side of the rotary elements. Since trims are thus correctly transferred onto guide tables by air ejection means referred to above, the trims can be properly guided into the trim chute.

The above-mentioned and other features and advantages of the present invention will become more apparent by reference to the following description of the preferred embodiment taken in conjunction with the accompanying drawings.

A BRIEF DESCRIPTION OF THE DRAWINGS

DETAILED DESCRIPTION OF THE PREFERRED EMBODIMENT

Figure 1:
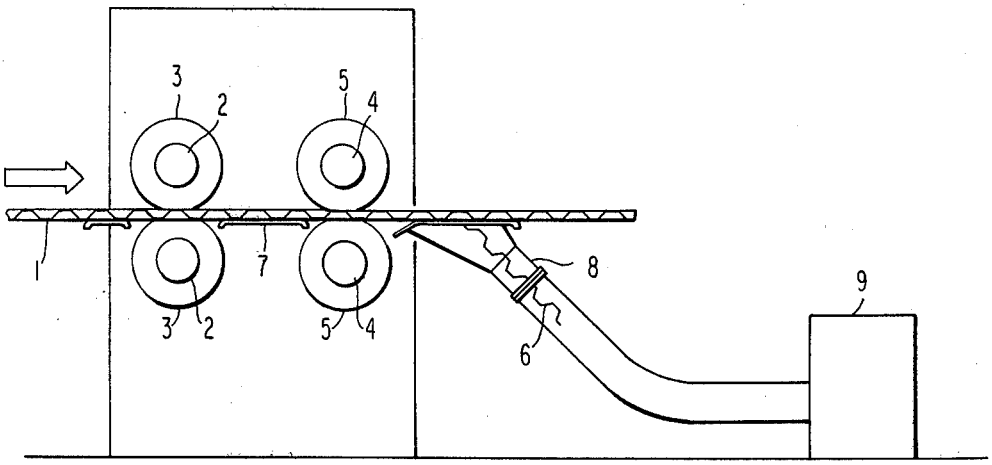
FIG 1 PRIOR ART
FIG. 1 is a schematic view of a conventional slitter-scorer as a whole.
Figure 2:
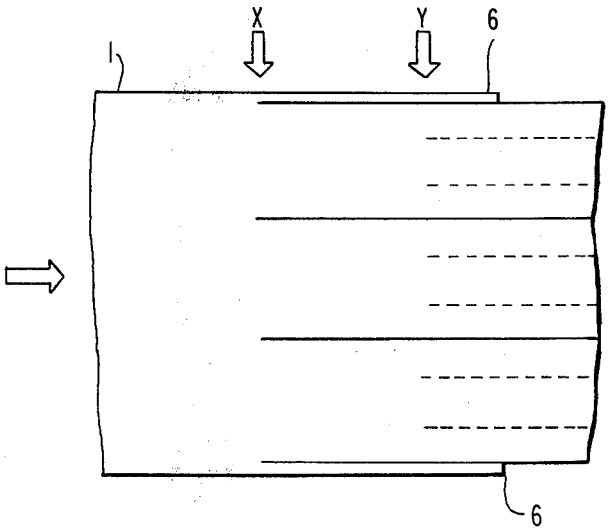
FIG 2 PRIOR ART
FIG. 2 is a plan view of a corrugated board sheet being subjected to slitting and scoring treatments in a slitter-scorer.
Figure 3:
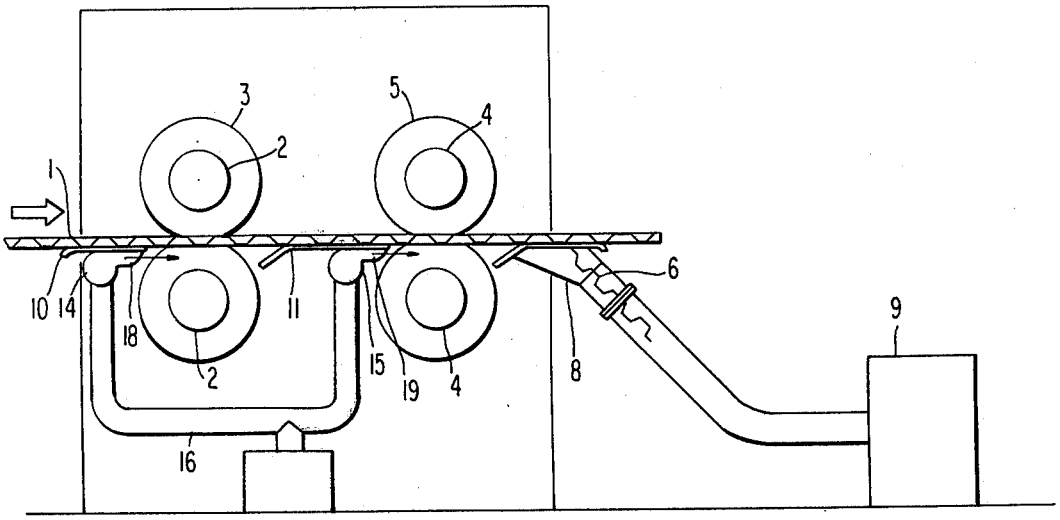
FIG. 3 is a schematic view in side elevation of a trim guide device for slitter-scorer embodying the present invention.
Figure 4:
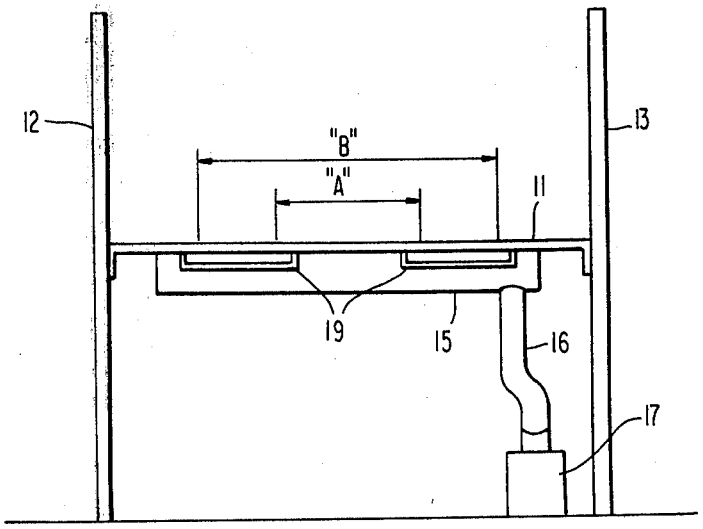
FIG. 4 is a front elevational view of the embodiment shown in FIG. 3.

The most preferable embodiment of the present invention will be described in detail with reference to FIGS. 3 and 4. The reference numerals in FIGS. 3 and 4, which are the same as those in FIGS. 1 and 2 designate the same parts. Referring to FIGS. 3 and 4, reference numerals 10, 11 denote guide tables fixed to frames 12, 13, respectively, and adapted to guide a corrugated board sheet 1. Duct pipes 14, 15 are fixed to the lower surface of the guide tables 10, 11, respectively, such that the duct pipes 14, 15 are substantially at right angles to the guide tables 10, 11, respectively. Reference numeral 17 denotes a blower which is connected to the duct pipes 14, 15 via a duct hose 16. The duct pipes 14, 15 are provided with nozzles 18, 19, respectively, at the downstream side with respect to the flow of the corrugated board sheet 1 thereof. Each of the nozzles 18, 19 has a width somewhat greater than a half of the differential between measurements A, B shown in FIG. 4. The measurements A, B represent minimum and maximum widths, respectively, of a corrugated board sheet to be fed into a slitter-scorer.

In the above embodiment constructed as described above, trims 6 at both ends of a corrugated board sheet 1 which has been slit by slitter knives 3 mounted on rotary shafts 2 are guided by the current of air ejected from nozzles 18 onto a guide table 11 disposed on the downstream side with respect to the flow of the corrugated board sheet 1. The trims 6 are further guided into a trim chute 8 by the current of air ejected from nozzles 19.

Since trims occurring in the above embodiment while a corrugated board sheet is slitted are guided correctly into a trim chute by the current of air ejected from nozzles and by guide tables, the trims never drop between rotary shafts and guide tables or between rotary shafts and trim chute, nor are they wound around the rotary shafts. Also, when a new corrugated board sheet on a new order (which has a different width) is fed into a slitter-scorer, the corner portions of the corrugated board sheet are never caught by a guide table on the upstream side of rotary shafts, or by the open end of a trim chute. Accordingly, the jamming of corrugated board sheets never occurs.

We claim:

1. A trim guide device for slitter-scorers in which a corrugated board sheet transferred on guide tables is slit by rotary elements disposed above and below the corrugated board sheet, to be thereafter scored by similar rotary elements, comprising air ejection means disposed under the lower surface of those portions of said guide tables which are on the upstream side with respect to the flow of the corrugated board sheet of said rotary elements, and directed to eject air under said lower surface of said guide tables toward the downstream side of the flow of the corrugated board sheet.

2. A trim guide device as claimed in claim 1, wherein said air ejection means comprise a duct pipe disposed transversely under the lower surface of said guide tables and provided with two nozzles, one at each end portion thereof, and a blower connected to said duct pipe for supplying air.

3. A trim guide device as claimed in claim 2, wherein each of said nozzles has a width sufficient to cover the corresponding edge of the corrugated board sheet over the full range of width of the corrugated board sheet intended to be fed to the slitter-scorer between the minimum width and the maximum width of such sheets.

4. A trim guide device as claimed in claim 2 wherein each of said nozzles is positioned in line with a corresponding edge of corrugated board sheet fed to the slitter-scorer, and each of said nozzles has a width which is greater than half the difference between the maximum and minimum width of corrugated board sheet intended to be fed to the slitter-scorer.

* * * * *